US006733633B2

(12) United States Patent
Josef

(10) Patent No.: US 6,733,633 B2
(45) Date of Patent: May 11, 2004

(54) PULL-ON LEADER

(75) Inventor: Michael J. Josef, Greenville, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/177,821

(22) Filed: Jun. 21, 2002

(65) Prior Publication Data

US 2003/0234090 A1 Dec. 25, 2003

(51) Int. Cl.[7] ..... D21F 1/24

(52) U.S. Cl. ..... 162/273; 162/274; 162/358.1; 162/200; 162/193; 162/900; 162/902; 426/131; 426/192; 426/193; 426/105; 426/107; 426/280; 426/43; 34/120

(58) Field of Search ..... 162/273, 274, 162/358.1, 200, 193, 900, 902; 428/131, 138, 43, 99, 192, 193, 105, 107, 280; 34/120

(56) References Cited

U.S. PATENT DOCUMENTS

| | | | |
|---|---|---|---|
| 4,758,309 | A | 7/1988 | Johansson |
| 5,306,393 | A | 4/1994 | Rhyne |
| 5,429,719 | A | 7/1995 | Rhyne |
| 6,398,915 | B1 | 6/2002 | Fargeout |

*Primary Examiner*—Steven P. Griffin
*Assistant Examiner*—Mark Halpern
(74) *Attorney, Agent, or Firm*—Frommer Lawrence & Haug LLP; Ronald R. Santucci

(57) ABSTRACT

A leader which is used to pull a seamable papermaker's fabric onto a paper machine comprising a ravel area for securing pull ropes or cables thereto.

11 Claims, 6 Drawing Sheets

PULL-ON LEADER

FIELD OF THE INVENTION

The present invention is directed towards a leader used to pull a seamable papermaker's fabric onto a paper machine particularly one that is durable and allows its reuse.

BACKGROUND OF THE INVENTION

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. All dryer fabrics used all have a seam of some type. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

An important aspect of loading a fabric body onto a paper machine is that there be uniform tension across the fabric. If uniform tension is not achieved and one section of the fabric pulls more than another, then the fabric can bubble or ridge across the fabric width.

Another aspect of loading a fabric body is preventing damage to the fabric body seam. In order to avoid or minimize the chance of damage to the seam during installation, tension, weight and pressure must be avoided on the seam itself.

A further aspect of loading a fabric, especially very long ones is properly aligning the fabric body in the machine so the fabric guides true in the machine direction (MD) and does not oscillate or track to one side of the machine. If the fabric guides or tracks poorly it can make contact with the paper machine support frame and cause fabric damage.

For fabrics and belts with seams that can be joined together on the paper machine, various types of leaders have been tried to assist installation. In order to avoid or minimize the potential for damaging the fabric body and the machine during installation and operation, the leader should be designed so there is uniform tension across the fabric body. There have been several attempts to design such leaders. It might be noted at this point that the term "leaders" and "harness" have often been used interchangeably. Sometime actually leaders are attached to harnesses and vice versa.

U.S. Pat. Nos. 5,306,393 and 5,429,719 both to Rhyne describe a device and method for installing a fabric body onto a paper machine. The method includes providing a self-aligning fabric loading harness having a leading edge and a plurality of spaced empty grommets disposed adjacent to the leading edge, to which multiple ropes are attached, securing a pull rope through loading harness and a line receiving device, pulling the pull rope, and automatically readjusting the pull rope through the loading harness to attempt to achieve uniform tension across the fabric. The use of metal grommets is relatively expensive both in labor and material costs. Typical leaders use an average of 13 grommets per leader. In addition, grommets are located in fixed locations which does not allow for adjusting the positioning of the pull rope to allow for tension variations. Moreover, grommets may not be perfectly aligned and have on occasion fallen out which could be very detrimental if they fall into the machine.

Other leaders take the form of a strip of material attached to the end of the fabric having apertures for gripping such as that set forth in U.S. Pat. No. 4,758,309 to Johansson.

Some leaders are square or rectangular, with the long dimension to either the MD or CD. Multiple ropes or straps are attached to the leader at evenly spaced apart locations across the width of the leader, and the leader with the attached papermaker's fabric or belt is pulled through the fabric run, and the ends of the papermaker's fabric or belt are brought together and joined by a seam to make the fabric endless. The leader is removed and the fabric is ready for use.

There are also leaders currently used in the industry which are shaped like an isosceles triangle, having the apex removed to form a trapezoid. The leaders are fabricated from a woven material. The material can also be a nonwoven from which the leader is fabricated. The base of a leader has a zipper, which is used to attach the leader to an end of the fabric being installed on the paper machine. Such a design is sometimes preferred because only one rope is attached near the apex to pull the fabric onto the machine. When the triangle is cut from woven material, one of the yarn systems in the weave goes straight from the base to the apex and the other is at a 90 degree angle thereto.

FIG. 1 shows a top view of a prior art leader 10. Leader 10 is shaped like an isosceles triangle and is fabricated from a woven material. The base 12 of leader 10 has a one half a zipper edge 12, which is used to attach leader 10 to an end of the fabric being installed on the paper machine to which the other half of the zipper edge is attached to the fabric or belt. Papermill personnel can attach a rope near the apex which is provided with a hole 14 and pull the fabric onto the machine. When the triangle is cut from woven material, one of the yarn systems in the weave goes straight from the base to the apex and the other is at a 90 degree angle thereto. When the rope is pulled as shown in FIG. 1*a*, the force is unevenly distributed across the leader as well as the attached fabric body which causes fabric body to bunch up on the sides.

Full width steel bars may be inserted at the base of the leader for better weight/tension distribution. However, the bars are heavy, thick and sometimes difficult to pass through the nip formed by two press rolls, or a shoe and opposing roll.

With a leader of this type, even with a 4 foot wide (in the cross machine direction or CD) steel reinforcing bar at the apex of the triangle/trapezoid, when the rope is pulled the force is unevenly distributed about the leader and across the attached fabric body. When the apex above is pulled, most of the force is distributed over four feet in the CD at the center of the leader. This causes the center of the fabric to bunch up, making it more difficult to seam, and often causes the edges of the fabric or belt 16 and leader 10 to droop 18 and 20 while it is being pulled onto the paper machine.

The drawback of this type of leader is that the load is always concentrated down its center. This causes,both the center of the leader and the fabric attached to it, to lead the edges and form waves in the center while pulling through the machine, making it more difficult to seam as well as guide the fabric through the run during installation. This often causes the edges of the fabric to droop while it is being pulled through the fabric run. Any fabric edge droop or bunching/waviness (any departure from a relatively flat fabric profile) can cause the fabric to become hung up on stationary equipment, or to not easily pass through the gap formed between two press rolls. Attempts to correct both the fabric and leader edges from drooping by inserting ropes down the edges, usually results in the edges curling up and folding over, which is also not desirable.

While the types of methods and devices for installing an on machine seamable fabric or belt aforementioned have particular advantages, they also have attendant disadvantages discussed above.

A leader device that has, however, been found to be particularly effective in pulling a seamable papermaker's fabric onto a paper machine is that set forth in U.S. Pat. No. 6,398,915 B1 to Fargeout, the disclosure of which is incorporated herein by reference. It provides for a leader having a shape substantially that of a triangle having a plastic coated substrate with reinforcing strips.

While the foregoing leader has proven effective in addressing certain shortcomings of prior leaders, as with anything, improvements or effective alternatives are always desirable.

SUMMARY OF THE INVENTION

It is therefore a principal object of the invention to overcome some of the shortcomings of the devices heretofore mentioned.

It is a further object of the invention to provide a device and method for installing a fabric in a paper machine which evenly distributes the load on the fabric making for easier installation and seaming.

It is a further object of the invention to provide a device for installing a fabric in a paper machine which is durable and allows for repeated use.

The leader of the present device is preferably made from a woven durable material and would preferably extend the width of the fabric being installed in the cross-machine direction. The leader is comprised of two ravel areas running substantially parallel to each other the width of the leader. The first ravel area would be placed over the seaming loops or other seaming mechanism at the cross-machine end of the fabric with the use of a pintle through the loops securing one side of the leader thereto.

The second ravel provides space for securing ropes or cables thereto at such intervals as may be desired. This allows for a secure attachment of pulling ropes or cables without the use of grommets and allows them to be so positioned to allow a uniform tension across the fabric during the pulling operation, since they can, if necessary, be repositioned during use.

While it is preferred that the leader be provided with two ravels, one for the fabric and one for the pulling ropes, it is also envisioned that other means for attaching the leader to the fabric may be used such as a zipper arrangement.

BRIEF DESCRIPTION OF THE DRAWINGS

Thus by the present invention its objects and advantages will be realized, the description of which should be taken in conjunction with the drawings wherein.

DETAILED DESCRIPTION OF THE PREFERRED EMBODIMENTS

Figure 1:
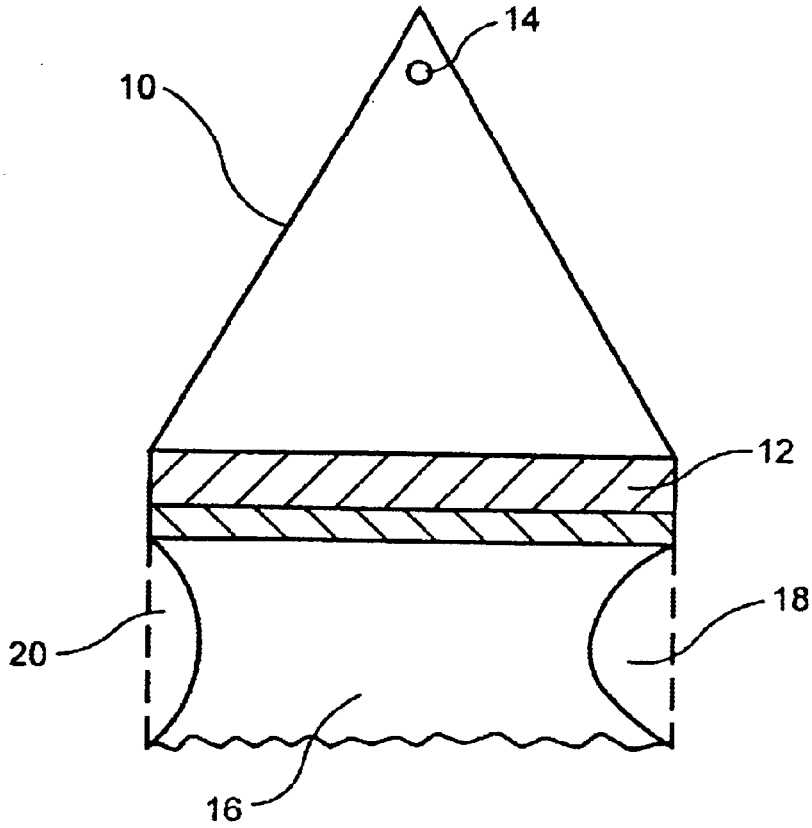
F I G. 1 PRIOR ART
FIG. 1 shows a top view of a prior art leader.
Figure 1A:
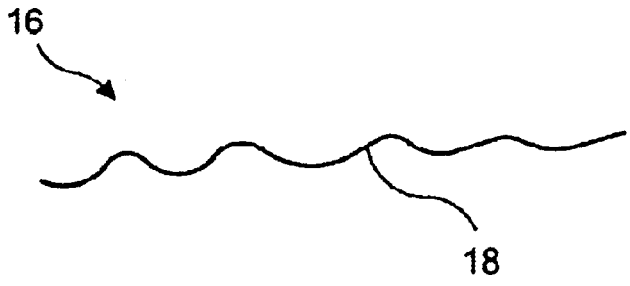
F I G. 1a PRIOR ART
FIG. 1*a* shows a side view of fabric attached to the leader of FIG. 1 after it has been pulled.
Figure 2:
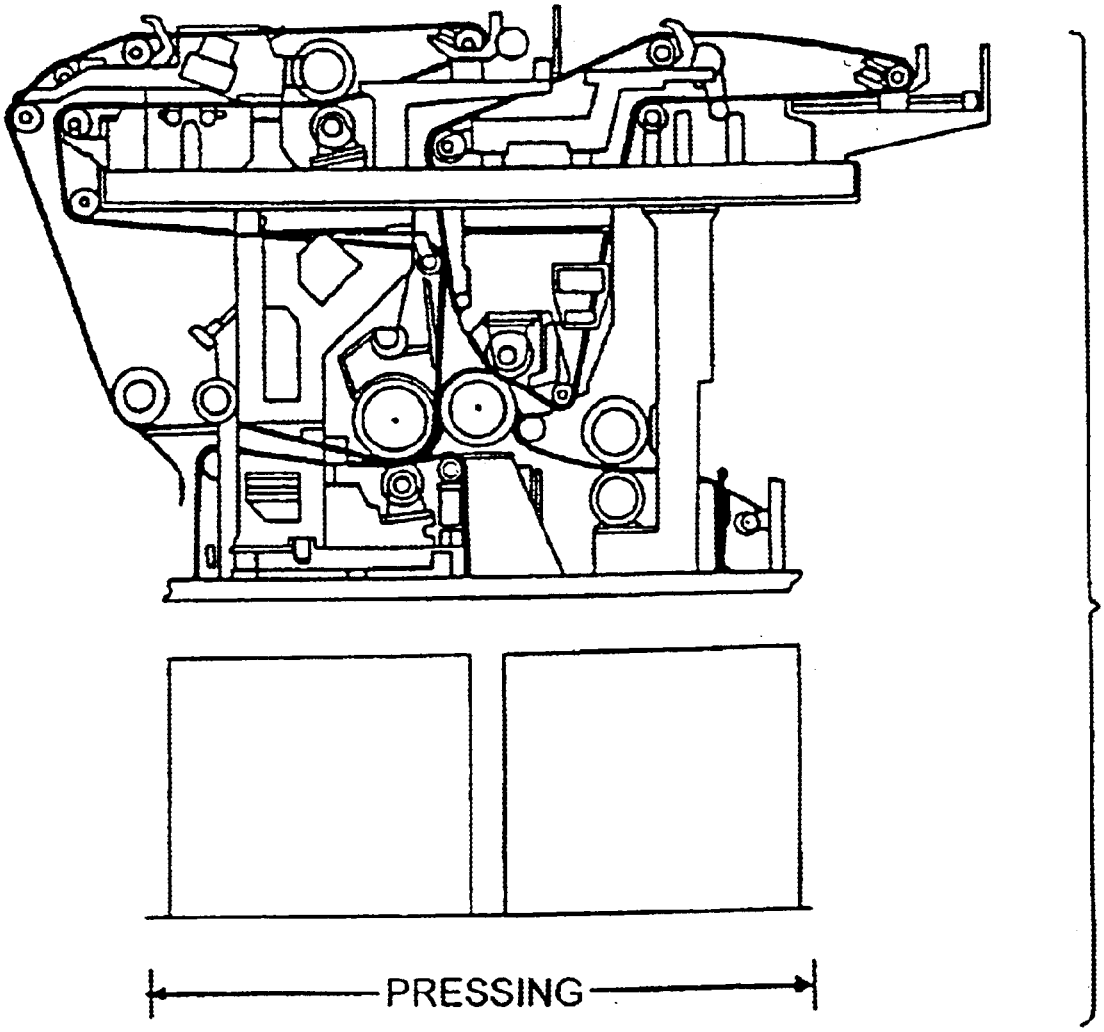
FIG. 2 shows a side view illustrating a press section used in papermaking.
Figure 3:
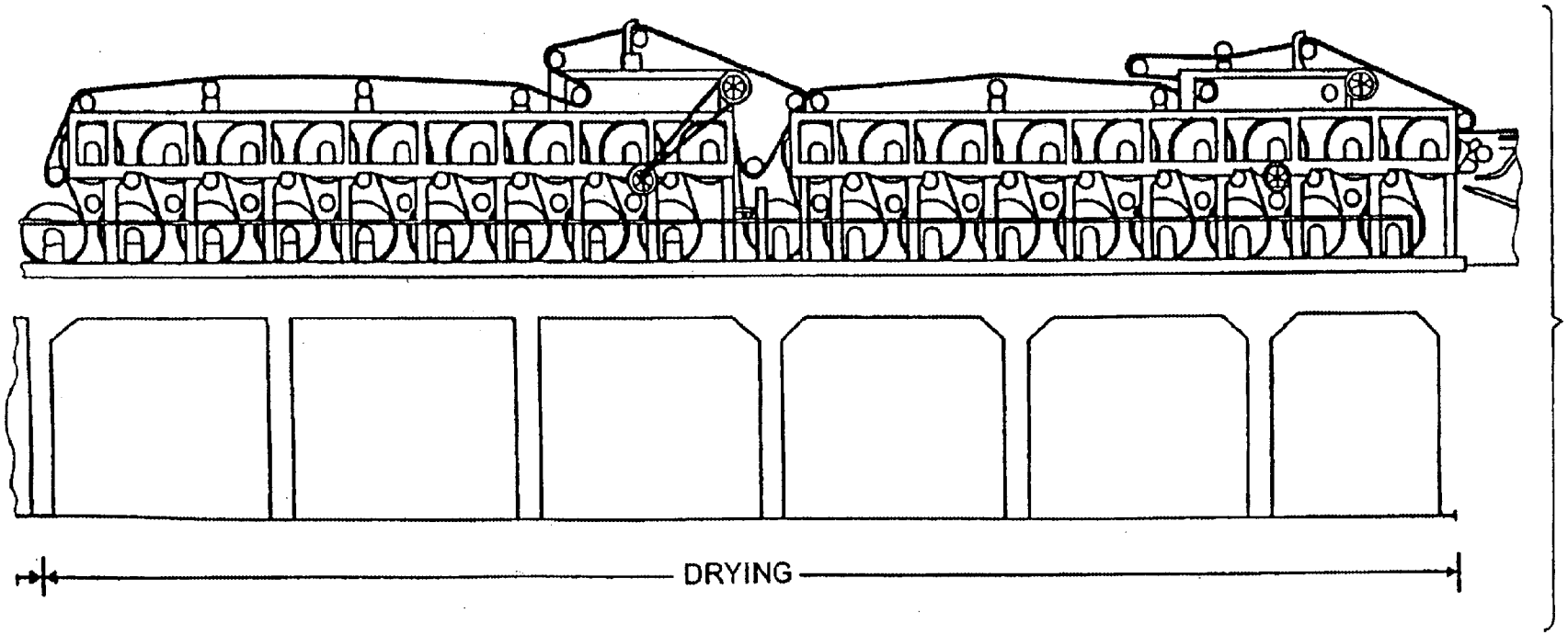
FIG. 3 shows a side view illustrating a dryer section used in papermaking.

Initially, FIG. 2 shows a side view of the press section of a papermaking machine. FIG. 3 shows a side view of the drying section of a typical papermaking machine. The path of the fabric used in these sections is illustrated therein.

Figure 4:
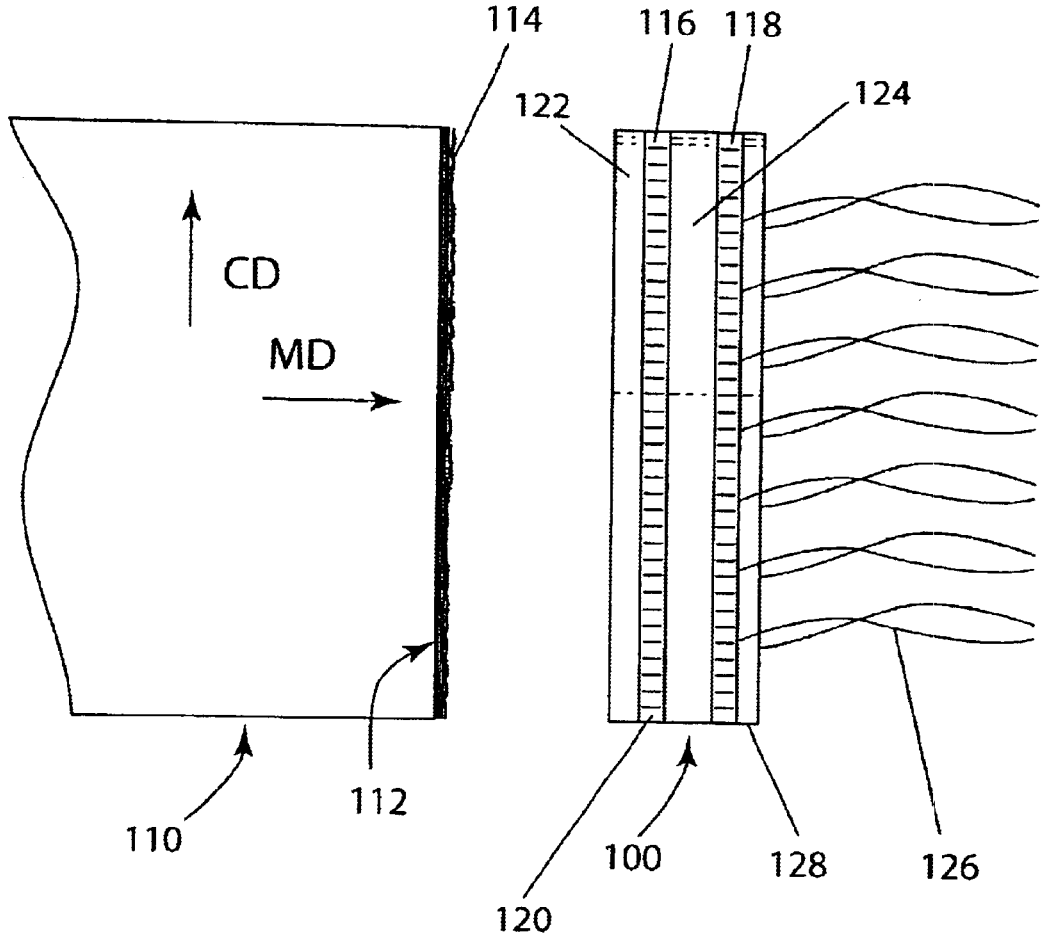
FIG. 4 shows a top view of a preferred embodiment of the present invention.
Figure 5:
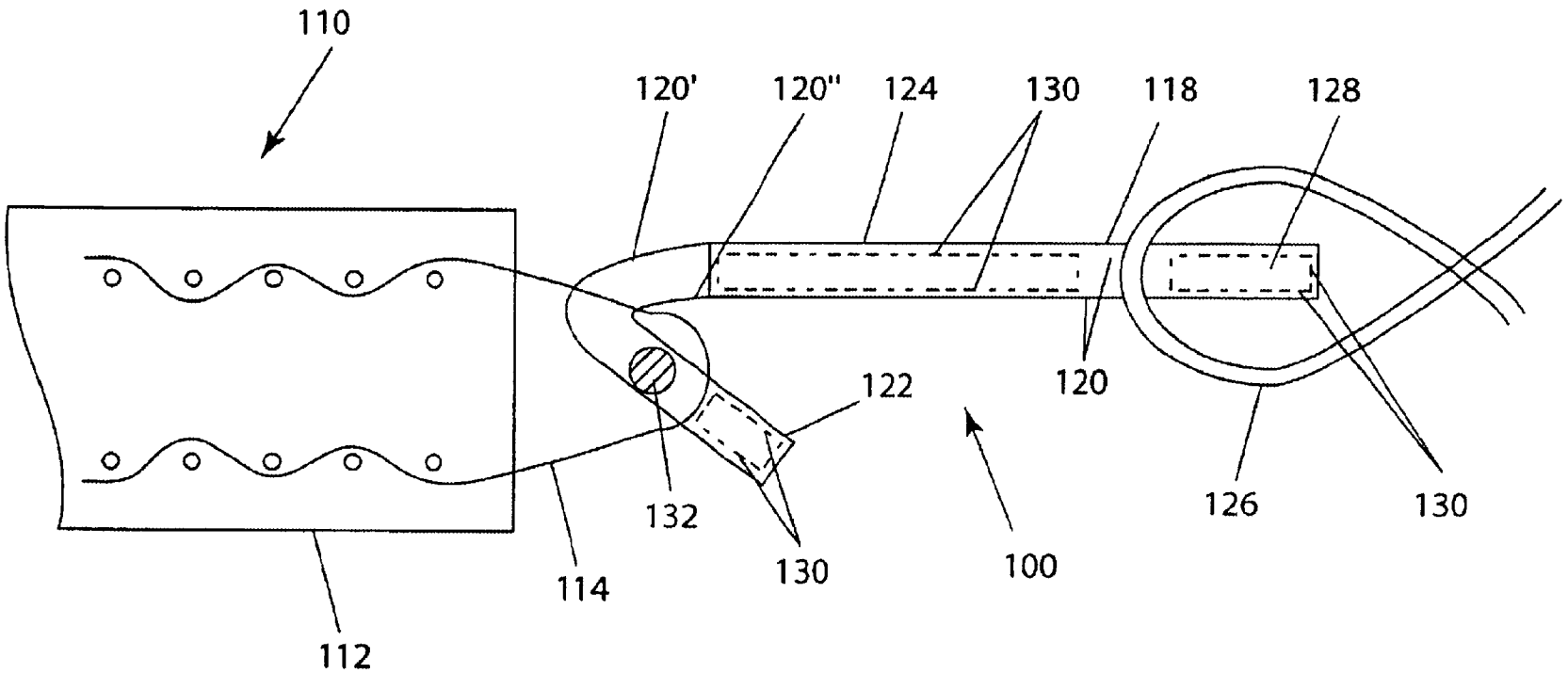
FIG. 5 is a side sectional view of the preferred embodiment of FIG. 4 attached to fabric.

In FIGS. 4 and 5 there is shown an embodiment of the present invention illustrated as leader 100. It should be noted that the figures are not drawn to scale, but rather to merely depict the present invention in a manner best understood. The leader 100 is somewhat rectangular in shape, formed as a strip to attach to the cross-machine leading end 110 of a on-machine-seamable fabric 112.

Such fabric 110 may be of any type; woven, non-woven, laminated, spiral formed, or other type suitable for the purpose, which is on-machine-seamable. As shown, fabric 110 includes seaming loop 114 at end 112. Obviously, the other end (not shown) will have complementary seaming loops so that once the fabric 110 is in place, it can be joined together rendering it endless. Also, while seaming loop 114 are illustrated, any seaming mechanism suitable for the purpose may be utilized so long as the leader is attachable thereto.

Turning now more particularly to the leader 100, it is preferably made from a woven durable material. It can be cotton, nylon, polyester yarns or a combination thereof or other material suitable for the purpose. The yarns are preferably multifilament but can also be monofilament, plied monofilament, spun fiber, or any combination thereof. The leader 100, if of woven material, includes ravel area 116 and ravel area 118. Ravel area 116 is approximately 1" wide and is formed from a plurality of machine direction yarns 120. Yarns 120 connect front solid fabric portion 122 to a center solid fabric portion 124 of the leader 100.

Ravel area 118 is usually somewhat wider than ravel area 116, since it accommodates the pulling ropes or cables 126 and is about 1" to 2" wide. Similarly, it connects center portion 124 to a rear solid fabric portion 128.

Note that the ravel areas 118 and 120 comprise machine direction continuous yarns which may be some or all of the machine direction yarns making up portions 122, 124 and 128 as illustrated by the dash lines 130 shown in FIG. 5. Also, yarns 120 may be made of any material suitable for the purpose and may be different from that making up the cross-machine direction yarns of portions 122, 124 and 128.

Turning more particularly to FIG. 5, it depicts a side sectional view of the leader 100 attached to the fabric 112. To accomplish this, the ravel area 116 is placed over the seaming loops 114 such that yarns 120 create a loop so that a pintle 132 can pass between the top portion 120' of yarn 120 and the bottom portion 120" of yarn 120, removably attaching the leader 100 to the fabric 112. The leader 100 can extend across the full cross-machine edge 110 of the fabric 112 or only a portion thereof as long as it is sufficient enough to be effective.

As to ravel area 118, it will serve to allow ropes or cables 126 to pass therethrough and then tied about portion 128. The fabric 112 can now be pulled onto the papermaker's machine.

Note that, while it is preferable to have ravel area 118 extend the entire, or substantially the entire, width of the leader 100, it need not. It might only exist in the areas to which the ropes or cables are to be attached. This, of course, would, to a certain extent, limit the repositioning of the ropes or cables during use to adjust for tension variations in various applications. In the case where ravel area 118 does extend the width of the leader 100, it may be desirable to mark thereon the preferred location of the ropes or cables for the particular applications.

Once in place, the pintle 132 is removed, detaching the leader 100, with the ends of the fabrics joined together.

It should be noted that the number of machine direction yarns in the ravel areas should be sufficient to provide the necessary strength for pulling the fabric, but should not be so great as to preclude the insertion of the seaming loop or the rope or cable into (and through) such areas.

Figure 6:
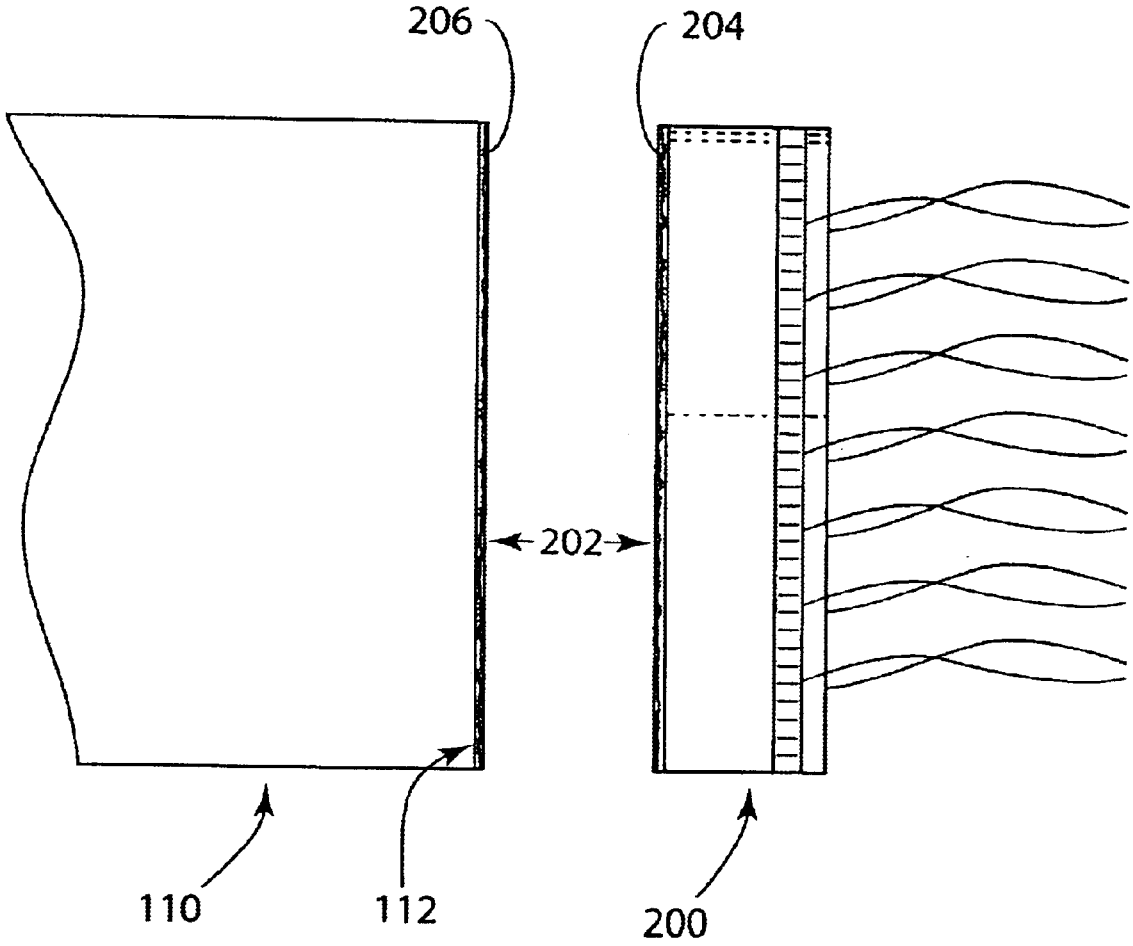
FIG. 6 shows a top view of an alternate embodiment.

Turning now briefly to FIG. 6, another embodiment of the invention is shown with like parts similarly numbered. In this embodiment, leader 200 differs from leader 100 in that instead of using ravel area 116 to attach to the fabric 112, it uses a zipper 202. In this regard, one half 204 of the zipper 202 is attached to the leader 200, the other half 206 is attached to the fabric 112 (or the seaming loops 114). The halfs are then joined and zipped together.

While a woven leader has been referred to, non-woven materials, including reinforced and non-reinforced spun-bonds might also be used. Knitted material can also be used. Triaxial woven material can also be used.

Also, the design avoids the use of multiple grommets across the width which is undesirable, for the reasons given as aforenoted.

Thus by the present invention its objects and advantages are realized and although preferred embodiments have been disclosed and described in detail herein, their scope should not be limited thereby; rather their scope should be determined by that of the appended claims.

What is claimed is:

1. A fabric loading leader for installing a papermaker's fabric having a leading edge across its width in the cross-machine direction, said leader comprising:

a center portion having a width;

a rear portion coupled to the center portion;

a first ravel area positioned between said center portion and said rear portion so as to allow a rope or cable to be positioned about said rear portion so as to effect a pulling thereon; and means for attaching said leader to the leading edge of the fabric.

2. The fabric loading leader device according to claim 1, wherein said means for attaching comprises a second ravel area located on a side of the center portion opposite the rear portion.

3. The fabric loading leader device according to claim 2 which includes a front portion with said second ravel area coupling said front portion to said center portion.

4. The fabric loading leader device according to claim 1, wherein said first ravel area extends the width of the center portion.

5. The fabric loading leader device according to claim 2, wherein said second ravel area extends the width of the center portion.

6. The fabric loading leader device according to claim 4, wherein said second ravel area extends the width of the center portion.

7. The fabric loading leader device according to claim 1, wherein the width of the center portion is substantially that of the width of the leading edge.

8. The fabric loading leader device according to claim 1, wherein the means for attaching includes a zipper, one half of which is on the leading edge, and one half on the center portion.

9. The fabric loading leader device according to claim 8, wherein said first ravel area extends the width of the center portion.

10. The fabric loading leader device according to claim 9, wherein the width of the center portion is substantially that of the leading portion.

11. The fabric loading leader device according to claim 6, wherein the width of the center portion is substantially that of the leading portion.

* * * * *